United States Patent [19]

Krassnig

[11] 4,440,313

[45] Apr. 3, 1984

[54] VENDING MACHINE FOR FLAT ARTICLES

[76] Inventor: Manfred Krassnig, Karl-Friedrich-Gauszstrasse 33 (Kärnten), A-9020 Klagenfurt, Austria

[21] Appl. No.: 315,676

[22] Filed: Oct. 27, 1981

[30] Foreign Application Priority Data

| | | | |
|---|---|---|---|
| Oct. 30, 1980 | [AT] | Austria | 5359/80 |
| Aug. 17, 1981 | [AT] | Austria | 3593/81 |
| Sep. 14, 1981 | [DE] | Fed. Rep. of Germany | 3136334 |
| Sep. 14, 1981 | [DE] | Fed. Rep. of Germany | 8126732[U] |

[51] Int. Cl.[3] ..... B65H 3/22; G07F 11/16

[52] U.S. Cl. ..... 221/213; 221/248; 221/255

[58] Field of Search ..... 221/213, 214, 215, 216, 221/255, 256, 252, 248; 194/54

[56] References Cited

U.S. PATENT DOCUMENTS

| | | | |
|---|---|---|---|
| 823,036 | 6/1906 | Crites et al. | 221/257 |
| 1,049,414 | 1/1913 | Shepherd | 221/213 |
| 2,195,305 | 3/1940 | Heaton | 221/213 |
| 3,082,912 | 3/1963 | Hawks | 221/213 |
| 3,161,320 | 12/1964 | Swanson | 221/255 |

FOREIGN PATENT DOCUMENTS

| | | | |
|---|---|---|---|
| 73090 | 5/1893 | Fed. Rep. of Germany | 221/213 |

*Primary Examiner*—Joseph J. Rolla
*Assistant Examiner*—Charles C. Compton
*Attorney, Agent, or Firm*—Martin A. Farber

[57] ABSTRACT

Vending machine for flat articles having a housing at a portion of which there is an article delivery slot. Within the housing there is an ejection plate which can be moved by an actuating handle and by which one article at a time can be carried through the delivery slot from the stack of articles which is standing on an inclined supporting plate within the housing.

9 Claims, 8 Drawing Figures

VENDING MACHINE FOR FLAT ARTICLES

The present invention relates to a vending machine for flat articles such as newspapers or the like, which has a housing which has a delivery slot for the articles and a delivery device which can be actuated by a handle located outside the housing, the device having pointed projections extending in the delivery direction and facing the article to be delivered, the articles being arranged on a support plate which inclines downward to the delivery device and has an upwardly extending bend at its lower edge.

Vending machines with delivery means which can be actuated by the insertion of coins or tokens have also been frequently proposed. In the vending machines known from Austrain Pat. No. 349 250 and the one known from Austrian Pat. No. 331542, the newspaper to be delivered must first of all be raised above a barrier, i.e. pushed upwardly, before it can leave the vending machine at its bottom. The moving of the newspaper backward and forward is therefore necessary.

In Austrian Pat. No. 349250, the newspapers lie on a transport carriage with the lower end of which a small feeler plate is associated. The carriage, and necessarily also the feeler plate, must be gradually raised upon the removal of each newspaper by an amount equal to the thickness thereof, for which an extremely expensive mechanism is provided.

In Austrian Pat. No. 331 542, the newspapers which are arranged on an oblique slide path having an angular bend rest against the rigid front wall of the housing. The pressure with which they rest against this wall is increased by a spring-loaded pressing device. Therefore when a newspaper is removed it is necessary to overcome not only the friction between the newspapers but furthermore also the friction between the first newspaper and the wall of the housing, which in addition to this has friction-increasing openings for the action of driver pins.

One disadvantage in the known apparatus which results from the backward and forward movement of the paper to be removed is the necessity of bringing the driver points or some of them out of engagement with the newspaper at the correct time.

Vending machines are also known (Austrian Pat. No. 271 062, French Pat. No. 374 961 and West German OS No. 1 952 444) which deliver the newspapers at the top. In these vending machines, friction wheels, gearwheels or needle strips are provided as removal devices.

The vending machines known up to the present time are disadvantageous insofar as they are of relatively expensive construction and therefore costly as well as susceptible to breakdown. For this reason, many newspaper publishers have gone over to using so-called "dumb vendors" which leave it to the purchaser as to how many newspapers he removes and how much he pays for them.

Vending machines (West German OS No. 1 952 444) are also known, which while they can be opened only after the insertion of a coin or token, then, however, free their entire contents so that once again the number of newspapers which the buyer actually removes is left up to him.

The object of the present invention is to provide a vending machine of very simple and therefore economical construction which provides assurance that in each case only one flat article, such as for instance a newspaper, can be removed.

This object is achieved with a vending machine in which the delivery device is an ejection plate which bears the pointed projections approximately at its center and which can be displaced upward into its delivery position by actuation of the handle, in which position the plate extends partially out of the delivery slot provided in the top of the housing; that the ejection plate bears at its lower edge opposite the delivery slot at least one supporting projection which points towards the support plate; that the ejection plate and preferably, however, the entire housing of the vending machine, is arranged inclined rearwards by about 10°, the supporting plate forming an acute angle with the ejection plate.

With the vending machine of this invention assurance is had that in each case, due to the sharp projections on the ejection plate, one article is removed from the pile of articles resting on the support plate and pushed upwards through the slot out of the housing. Due to the fact that the bend of the support plate is arranged at a distance from the ejection plate assurance is also had that the pile of articles no longer rests with its full surface against the article acted on by the ejection plate so that there is no danger that other articles can be carried along upwards as a result of a large amount of friction. Furthermore, by the invention the article (newspaper) to be removed is supported over its full surface so that a kinking thereof is prevented. The movements for supporting articles which are necessary in the known apparatus (Austrian Pat. No. 293 074, West German OS No. 1 599 027 and Austrian Pat. No. 349 250) can be dispensed with. As compared with Austrian Pat. No. 331 542 there is furthermore the advantage that the newspaper is delivered at the top so that there is no danger that, upon the removal of one newspaper, the first page of the next newspaper will be simultaneously pulled down and damaged.

In order to prevent rain from penetrating into the vending machine through the delivery slot and in order to assure protection against unauthorized removal, a cap which covers the delivery slot from the outside, when the ejection plate has been pushed into the housing, may, within the scope of the invention, be fastened to the upper edge of the ejection plate.

The delivery device can be actuated with particular ease if the handle for the actuation of the ejection plate is a yoke which is mounted swingably around a horizontal axis on the housing.

In accordance with the invention, a spring-loaded pawl may be swingably mounted on the ejection plate, the pawl engaging behind a stop affixed to the housing when the ejection plate is pushed into the housing and being liftable out of this position by the insertion of coins and/or tokens. This embodiment provides assurance in a simple manner that the vending machine can be actuated only upon payment of the price for the article. This embodiment can furthermore be provided with a coin chute which adjoins a coin tester and extends approximately parallel to the ejection plate, the lower open end of the chute being arranged directly above a projection provided on the pawl, and that upon lifting of the ejection plate the pawl can be lifted from its locking position by the projection which slides along the coin.

In order that the articles (newspapers) cannot bend away from the ejection plate even when the machine is substantially empty, a weight developed, for instance, in U shape can be provided which sits in sliding manner on the support plate and urges the pile of articles against the ejection plate.

Further details of the invention will become evident from the following description of the embodiment shown in the drawings, in which.

Figure 1:
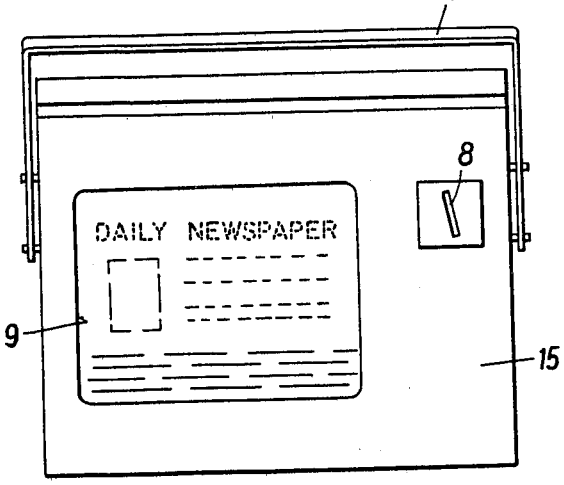
FIG. 1 shows a full vending machine in front elevation.
Figure 2:
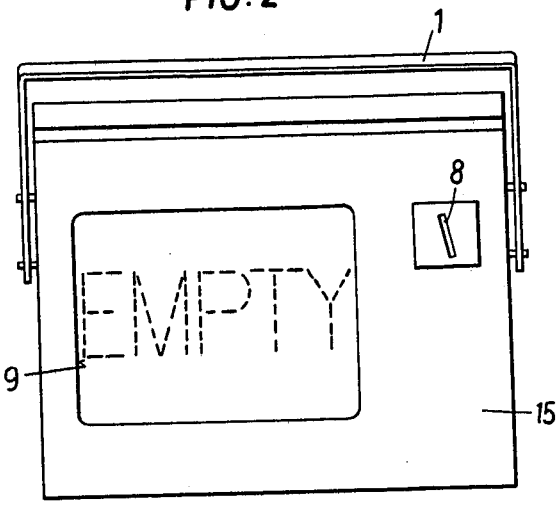
FIG. 2 shows the vending machine as in FIG. 1 after removal of the last article.

As shown in FIGS. 1 and 2, the vending machine has a housing 15 which can be made of sheet metal or plastic and is provided on its front with a viewing window 9 through which it can be noted whether there are any articles in the vending machine and what they are. An insertion slot 8 for coins and/or tokens is also provided. A U-shaped operating handle 1 is also pivotally connected to the housing, upon each swing of which handle one article is pushed out of the vending machine.

As shown in FIGS. 3 to 6, an ejection plate 2 is mounted in the region of the rear wall of the housing 15, the upper end of which plate passes through a slot 16 in the housing 15. The slot 16 in the housing 15 is covered by a cap 17 fastened to the ejection plate 2 so that the articles contained in the vending machine, such as newspapers for instance, are protected from inclement weather.

Approximately in the center of the ejection plate 2 there are two oblique upwardly directed sharp projections 3 while at its lower end there is a ledge or at least a support projection 5. The stack of articles 18 is seated in the vending machine on a support plate 4 which forms an acute angle with the ejection plate 2, and that end of the support plate which is adjacent the ejection plate 2 has an upwardextending bend 4'. Finally a weight 30, can be provided for instance bent in U-shape, a crosspiece 31 (partially sectioned) of which reset on the support plate 4 and arms of which rest on the stack of articles 18, so that the stack of articles 18 can be dependably pressed against the bend 4' and the articles cannot curve away from the ejection plate 2.

If the operating handle 1 is now pushed downward, the ejection plate 2, which is pivotally connected to a rear end of the operating handle, moves upwardly and its sharp projections 3 grasp that article in the stack of articles 18 which is immediately adjacent said projections. The article is drawn upward by the projections 3 and places itself then against the ejection plate 2, resting on the ledge or the support projections 5. It can be noted in particular from FIG. 4 that due to the bend 4' the rest of the stack of articles 18 rests only with a small area against the article present on the ejection plate 2 so that no large amount of friction can occur. In this way one prevents lifting two or more articles upon a single actuation of the handle 1. If the operating handle 1 has now been swung into the position shown in FIG. 5 the article can be grasped in the region 6 and removed from the ejection plate. Thereupon the operating handle 1 is moved back into the starting position (FIG. 6) and the ejection plate 2 is pushed down into the housing 15. The return movement of the plate 2 can also be effected or assisted by a spring and/or gravity.

Since, as a rule it is desirable for an article to be removable only after insertion of the proper coin or token, a locking device which can be disengaged by the insertion of one or more coins or tokens is associated with the operating handle 1 or the ejection plate 2, the locking device permitting only a single actuation of the operating handle after the insertion of the coin or token.

Figure 7:
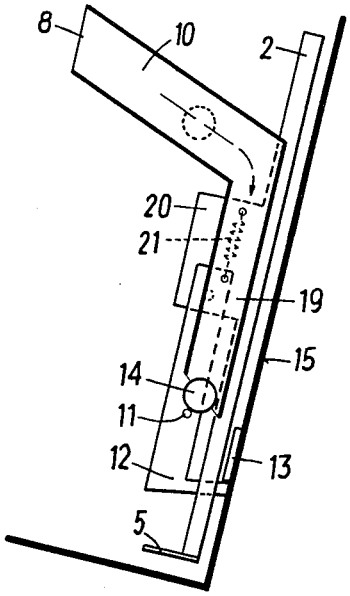
FIGS. 7 and 8 show, in different positions, a locking device which can be used in the vending machine of the invention.
Figure 8:
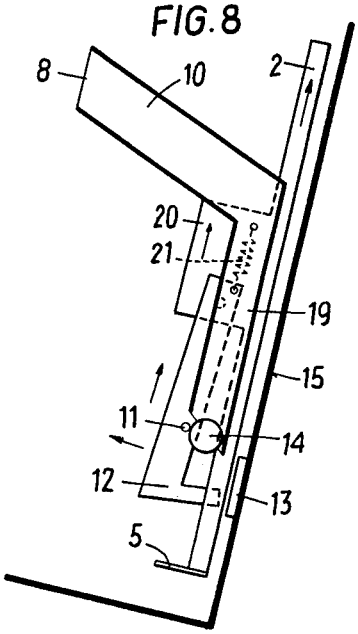
Figure 3:
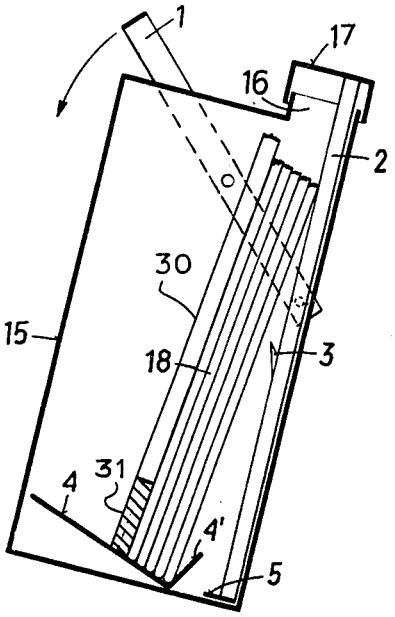
FIGS. 3 to 6 show a vending machine during the removal process diagrammatically and in cross section and in different positions.
Figure 4:
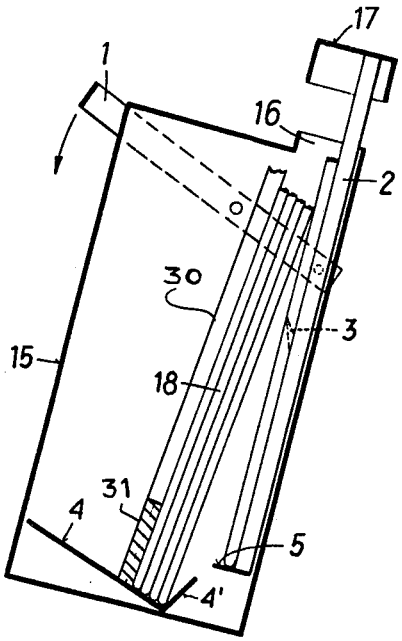

A locking device of preferred use for the invention is shown in FIGS. 7 and 8.

This locking device has a coin or token (both herein referred to generically as coins) tester 10 adjoining the coin insertion slot 8 and a downwardly extending coin chute 19 approximately parallel to the ejection plate 2. A pawl 12 is pivotally mounted on a bracket 20 provided on the ejection plate 2. The pawl 12 is so acted on by a spring 21 connected to the bracket 20 and the pawl 12 and biasing the lower end of the pawl counterclockwise that when the ejection plate 2 has been pushed into the housing the pawl lockably engages behind a stop 13 which is fastened to the housing. The pawl 12 furthermore has a projection 11 which, in the locked position of the pawl 12 shown in FIG. 7, is located below the coin chute 19. If now—as shown in FIG. 7—a coin 14 is at the lower end of the coin chute 19 then the projection 11, upon the lifting of the ejection plate 2, will slide along the curved edge of the coin 14 so that the pawl 12 comes free of the stop 13. This position is shown in FIG. 8. As soon as the ejection plate 2 has been lifted sufficiently far, the coin 14 can drop out of the coin chute 19 into a coin collector, not shown in detail.

Due to the fact that the ejection plate 2 and—as in the embodiment shown—the entire housing 15 are inclined rearwardly by an angle of about 10°, there is not only obtained a favorable possibility for the removal of the articles taken out (FIG. 5), but assurance is also provided that the articles which are to be pushed out rest dependably against the ejection plate 2. Another advantage of the apparatus in accordance with the invention is that the thickness of the individual articles is unimportant. It is even possible to move newspapers of different thickness to the removal slot from the same pile of goods without rearrangement. Furthermore, it is immaterial how many newspapers are present in the stack.

The ejection plate 2 which is visible through the window 9 after removal of the last article can, as shown in FIG. 2, bears a notice that the vending machine is empty.

It is possible to apply the principle of the invention also to vending machines which have the slot arranged on the side.

Figure 5:
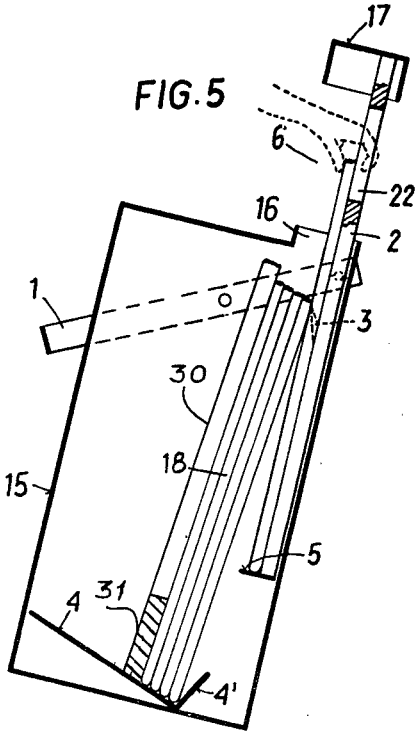
Figure 6:
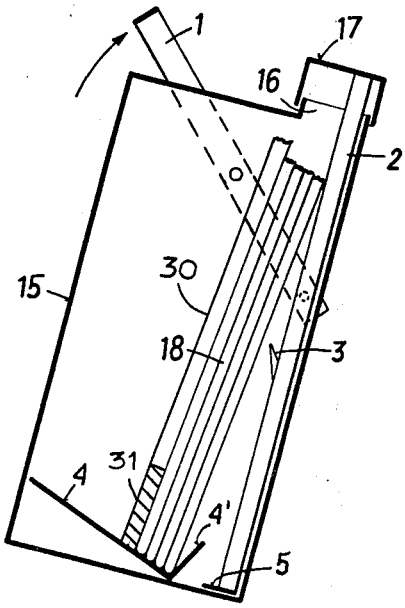

As indicated in FIG. 5, a cutout 22 is provided in the upper region of the ejection plate 2. The cutout 22 facilitates grabbing the article which has been lifted by the ejection plate 2 since the article can be grabbed on both sides at its upper edge within the region of the cutout 22.

I claim:

1. In a vending machine for flat articles, such as newspapers and the like, having a housing in which a delivery slot for the articles is provided, a delivery device actuatable by a handle disposed outside the housing, the delivery device having sharp projections directed in a delivery direction and facing an article to be delivered, a support plate on which the articles stand being inclined downwardly toward the delivery device and at its lower edge having an upwardly extending bend, the improvement wherein the delivery device comprises an ejection plate means carrying said sharp projections approximately at a center thereof and upon operation of the handle for being moved into a delivery position in which said ejection plate means extends in part out of the delivery slot, at least one supporting projection at an edge of said ejection plate means opposite the delivery slot, said at least one supporting projection is directed towards the support plate, said ejection plate means being arranged inclined rearwardly, the support plate forming an acute angle with said ejection plate means, and wherein said lower edge of said support plate is disposed away from a path of travel of said ejection plate for holding said articles away from said sharp projections prior to operation of said handle, the positioning of said support plate providing for engagement of one end of an article while an opposite end nearer said delivery slot is permitted to rest upon said ejection plate thereby providing for engagement of said sharp projections only after movement of said delivery plate.

2. The vending machine as set forth in claim 1, wherein the entire said housing is inclined rearwardly.

3. The vending machine as set forth in claim 1, wherein said ejection plate means is arranged inclined rearwardly by about 10°.

4. The vending machine as set forth in claim 1, wherein said delivery slot is formed in the top of the housing and said ejection plate means is movable upwardly into said delivery position upon the operation of the handle, and said edge is the lower edge of said ejection plate means.

5. The vending machine as set forth in claim 4, further comprising a cap means for covering the delivery slot from the outside when said ejection plate means is substantially completely inserted into the housing, said cap means being fastened on an upper edge of said ejection plate means.

6. The vending machine as set forth in claim 4, wherein the handle for operating the ejection plate means is a U-shaped handle which is mounted swingably around a horizontal axis on said housing.

7. The vending machine as set forth in claim 4, wherein said ejection plate means is formed with a cutout in the upper half thereof.

8. The vending machine as set forth in claim 4, further comprising a weight means for urging a stack of the articles towards said ejection plate means, said weight means being seated in sliding manner on the support plate.

9. The vending machine as set forth in claim 8, wherein said weight means has a U-shape.

* * * * *